US006431681B2

(12) United States Patent
Hatasa et al.

(10) Patent No.: US 6,431,681 B2
(45) Date of Patent: Aug. 13, 2002

(54) RECORDING APPARATUS, LIQUID CONTAINER CARTRIDGE AND LIQUID CONTAINER

(75) Inventors: Nobuyuki Hatasa, Kawasaki; Yutaka Koizumi, Yokohama; Yukuo Yamaguchi, Tokyo; Hideo Fukazawa, Chigasaki; Hiroki Tajima; Mikiya Umeyama, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,213

(22) Filed: Apr. 2, 2001

(30) Foreign Application Priority Data

Mar. 31, 2000 (JP) ..... 2000-097623

(51) Int. Cl.[7] ..... B41J 29/393
(52) U.S. Cl. ..... 347/19; 347/86
(58) Field of Search ..... 347/19, 14, 86, 347/50, 37, 29, 23

(56) References Cited

U.S. PATENT DOCUMENTS 6,267,463 B1 * 7/2001 Paulsen et al. ..... 347/19
6,293,649 B1 * 9/2001 Norton ..... 347/37

FOREIGN PATENT DOCUMENTS

| | | |
|---|---|---|
| EP | 478244 | 4/1992 |
| EP | 765757 | 4/1997 |
| WO | 98-52762 | 11/1998 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A recording apparatus for effecting recording by depositing the liquid onto a recording material, the liquid container including a memory element storing information, a first electrode connected to the memory, the liquid container being detachably mountable to a recording apparatus having a second electrode to be connected with the first electrode, wherein the information is read out when the liquid container is mounted to the main assembly of the recording apparatus; wherein the liquid container is provided with such a stepped portion that portion having the first electrode is recessed, and the second electrode is resiliently urged to a first electrode provided at the recessed portion.

9 Claims, 8 Drawing Sheets

RECORDING APPARATUS, LIQUID CONTAINER CARTRIDGE AND LIQUID CONTAINER

FIELD OF THE INVENTION AND RELATED ART

The present invention relates to a recording apparatus which has a liquid container removably mountable in the main assembly of a recording apparatus. In particular, the present invention relates to the structure of the juncture between the main assembly of a recording apparatus and a liquid container.

In an ink jet recording method, a desired recording is made by causing ink droplets to be shot out of microscopic ejection holes in an ink jet head in such a manner that the ink droplets land on recording medium.

Conventionally, a recording apparatus records on recording medium such as paper, fabric, plastic sheet, OHP sheet, and the like. It employs one of various recording heads different in the recording system they employ. As for the types of recording heads mounted in the main assembly of a recording apparatus, there are various recording heads different in the recording methods they use. For example, there are a wire-dot recording method, a thermal recording method, a thermal transfer method, and an ink jet method. Among various recording apparatus, those that employ an ink jet recording system (ink jet recording apparatuses) have been commercialized and have been used as an outputting means of an information processing system, for example, a printer as an output terminal of a copying machine, a facsimile machine, an electric typewriter, a word processor, or a work stations or a handy printer, that is, a portable printer, with which a personal computer, a host computer, a disk apparatus, a video apparatus, and the like, are provided.

The ink jet head of the above described ink jet recording apparatus is provided with ejection energy generation elements for generating the energy for ejecting ink from the ejection holes. As for examples of the ejection energy generation elements, there are an electromechanical transducer such as a piezoelectric element, a laser, an electrothermal transducer having a heat generating resistor, and the like. In the case of laser, electromagnetic waves are irradiated from the laser to generate heat used for ejecting ink droplets, and in the case of the electrothermal transducer, ink droplets are ejected by heating liquid by the electrothermal transducer.

In recent years, a great amount of progress has been made in the fields of computers and the software therefor. Consequently, it has become necessary for an ink jet recording apparatus to be capable of outputting a color image. In order to cater to such a necessity, some ink jet heads have been enabled to record in color.

Further, not only has it become necessary to record in color, but also to record with a high degree of preciseness. In the case of an ink jet recording method, the capability to output an image with a higher degree of preciseness and quality has been realized by increasing printing density, changing ink density, and/or the like. As a result, a recording apparatus which employs an ink jet method has come to be widely used not only by business people and computer professionals, but also by personal users in homes and small offices.

An ink jet recording apparatus such as the above described one requires a single or plurality of ink containers for holding ink. One example of such ink containers is an ink cartridge, which is removably mountable in the main assembly of an ink jet recording apparatus.

FIG. 8 is an exploded perspective view of an ink cartridge mountable in a conventional recording apparatus, and shows the structure thereof. FIG. 9 is a sectional view of the ink cartridge shown in FIG. 8.

As shown in FIGS. 8 and 9, this ink cartridge has an ink storage chamber formed by an ink container 541 and an ink container lid 542. It also has a waste ink storage chamber formed by a waste ink container 543 and a waste ink container lid 545. Within the waste ink container 543, an absorbent member 544 for absorbing and retaining the recovered ink (the shape of the absorbent member 544 in the drawing represents the shape of the absorbent member 544 after its installation into the waste ink container 543) is contained. The lid 542 is attached to the ink container 541 by supersonic welding. It is also by supersonic welding that the waste ink container 543 and its lid 545 are attached to each other.

The ink container 541 is provided with a plurality of tubular claw grippers 555, which are located on the external surface of one of the lateral walls of the ink container 541, and the waste ink container 543 is provided with a plurality of claws 554, which are located on the external surfaces of one of the lateral walls of the waste ink container 543. Thus, as the ink container 541 and waste ink container 543 are slid against each other, while keeping the lateral wall surface with claws 555 and the lateral wall surface with the tubular claw grippers flatly in contact with each other, the claws 554 engage into the tubular claw grippers 555, securing the ink container 541 and waste ink container 543 to each other.

As the ink container 541 and the waste ink container 543 are joined with each other, the external surface of the lid 542 and the external surface of the lid 543 become level with each other. These two surfaces are each provided with a housing 550 which contains an ink path. Each housing 550 is filled with a dorm-shaped elastic member 556, and is capped with a crown 547 or a fixing member. These components make up the joint portion through which the ink storage chamber is connected to the apparatus main assembly to allow ink to flow between the ink storage chamber and the apparatus main assembly. This joint portion and its adjacencies are surrounded by a wall 553 provided for preventing a hand or the like from coming in contact with them. The height of the joint portion is approximately the same as, or less than, that of the wall 553.

As an ink cartridge structured as described above is mounted into the recording apparatus main assembly, two hollow needles (unshown), with which the recording apparatus main assembly is provided, penetrate the corresponding elastic members 556, establishing two passages between the interior of the ink container 541 and the recording apparatus main assembly to allow the liquid within the ink container 541 to be sent to the recording apparatus main assembly in exchange for the air therefrom.

More specifically, the ink which has been stored in the ink container 541 is supplied to the recording apparatus main assembly through one of the hollow needles having penetrated the elastic members 556, and the air is sent into the ink container in return through the other hollow needle.

However, a conventional ink cartridge such as the one described above is not given a function of allowing a user to determine whether or not an ink cartridge has been properly mounted in the recording apparatus main assembly during the mounting of the ink cartridge into the recording apparatus main assembly Therefore, there is a possibility that an ink. cartridge will be pressed against the recording apparatus main assembly by an unnecessarily large amount of force, and such application of a large amount of force might result in damages to the ink cartridge and/or the recording apparatus main assembly. Also, there is a possibility that an ink cartridge might be repeatedly mounted or dismounted until a user becomes convinced than the ink cartridge has been properly mounted in the recording apparatus main assembly. Such repeated mounting or dismounting of an ink cartridge means more probable the occurrence of damages to the ink container or recording apparatus main assembly. In other words, lack of the aforementioned function completes a user to carry out an otherwise unnecessary operation, which is a problem.

SUMMARY OF THE INVENTION

The present invention was made in consideration of the problems, such as those described above, which the conventional technologies have. Thus, the principal object of the present invention is to provide a recording apparatus, a liquid container cartridge and a liquid container which informs a user that a liquid container has been properly mounted in the recording apparatus main assembly to reduce the possibility that the liquid container and/or the recording apparatus main assembly will be damaged.

According to the present invention which accomplishes the above described object, a recording apparatus, which records by adhering liquid to recording medium, comprises a main assembly and a liquid cartridge, the main assembly being provided with a second electrode which comes into contact with a first electrode, or the electrode on the ink container side, to allow the data stored in the storage element of the liquid container to be read by the apparatus main assembly side, and the liquid container being structured to be removably mountable in the main assembly, and provided with a storage element for storing data and a first electrode connected to the storage element, is characterized in that:

the liquid container is provided with a stepped portion, which creates a recess in which the first electrode is disposed; and the second electrode is provided with such resiliency that keeps the second electrode pressed upon the first electrode in the recess, or the portion created by the stepped portion.

The liquid container is characterized in that it is provided with a guiding means for guiding the liquid container when the liquid container is mounted into the recording apparatus main assembly, and the first electrode is positioned on the inwardly facing surface of the wall provided with the guiding means, in such a manner that the first electrode opposes the guiding means through the wall.

The liquid container is characterized in that it is provided with a space, the stepped side of which is provided with an opening through which the second electrode is inserted into the space, and that the first electrode and storage element are located within the space, The second electrode is characterized in that it is bent in such a manner that it does not contact the upper level portion of the aforementioned stepped portion, when the second electrode is in contact with the first electrode.

Further, according to another aspect of the present invention, a recording apparatus which records by adhering liquid to recording medium, and comprises a liquid cartridge removably mountable in the main assembly of the recording apparatus, is characterized in that:

the liquid container is provided with a hole having no relation to the supplying of liquid to the recording apparatus main assembly; and the recording apparatus main assembly is provided with a lever which engages into the hole as the liquid container is properly placed in the recording apparatus main assembly.

The liquid container is characterized in that it is provided with a space into which the second electrode is inserted, and the hole having no relation to the supplying of the liquid to the recording apparatus main assembly is located in this space.

The liquid container, which is provided with a storage element in which data is stored, and a first electrode connected to the storage element, is structured to be removably mountable in a recording apparatus provided with a second electrode to be connected to the first electrode, and stores the liquid used for recording, is characterized in that a portion of the liquid container, in which the first electrode to which the second electrode is to be connected is placed, is provided with a stepped portion.

The stepped portion is characterized in that the surface to which the first electrode is placed in recessed from the other surface, that is, the upper level, of the stepped portion.

The stepped portion is characterized in that the upper level of the stepped portion, is on the trailing end of the recess, in terms of the inserting direction of the second electrode, into which the second electrode is inserted to be placed in contact with the first electrode.

In a recording apparatus structured in accordance with the present invention as described above, as the liquid container is inserted to its normal position in the recording apparatus main assembly, a passage is established between the interior of the liquid container and recording apparatus main assembly to allow the liquid within the liquid container to be supplied to the recording apparatus main assembly, and also, electrical connection is established between the liquid container and recording apparatus main assembly to allow the data stored in the storage element provided on the liquid container side to be read by the recording apparatus main assembly. Toward the end of this insertion of the liquid container into the recording apparatus main assembly, the second electrode of the recording apparatus main assembly rides over the upper level of the stepped portion, while being kept pressed upon the upper level by its own resiliency, and snaps into the recess, coming into contact with the first electrode, as soon as it passes the upper level. As the second electrode snaps into the recess to come into contact with the first electrode, it provides a user with a clicking sensation while generating a clicking sound. The clicking sensation and sound enables a user to recognize that the liquid container has been properly mounted in the recording apparatus main assembly, and also that proper electrical connection has been established between the liquid container and recording apparatus main assembly, The liquid container may be provided with a hole unrelated to the supplying of liquid to the recording apparatus main assembly. In such a case, as the liquid container is inserted to its normal position in the recording apparatus main assembly, the lever provided on the recording apparatus main assembly side snaps into this hole of the liquid container, providing a user with a clicking sensation while generating a clocking sound, which enables the user to recognize that the liquid container has been properly mounted in the recording apparatus main assembly.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4(*a*) shows the container holder with the container rail, and FIG. 4(*b*) shows the container holder, with the container rail shown in FIG. 4(*a*) having been removed.

DESCRIPTION OF THE PREFERRED EMBODIMENTS

Hereinafter, the embodiments of the present invention will be described with reference to the appended drawings.

[Embodiment 1]

Figure 1:
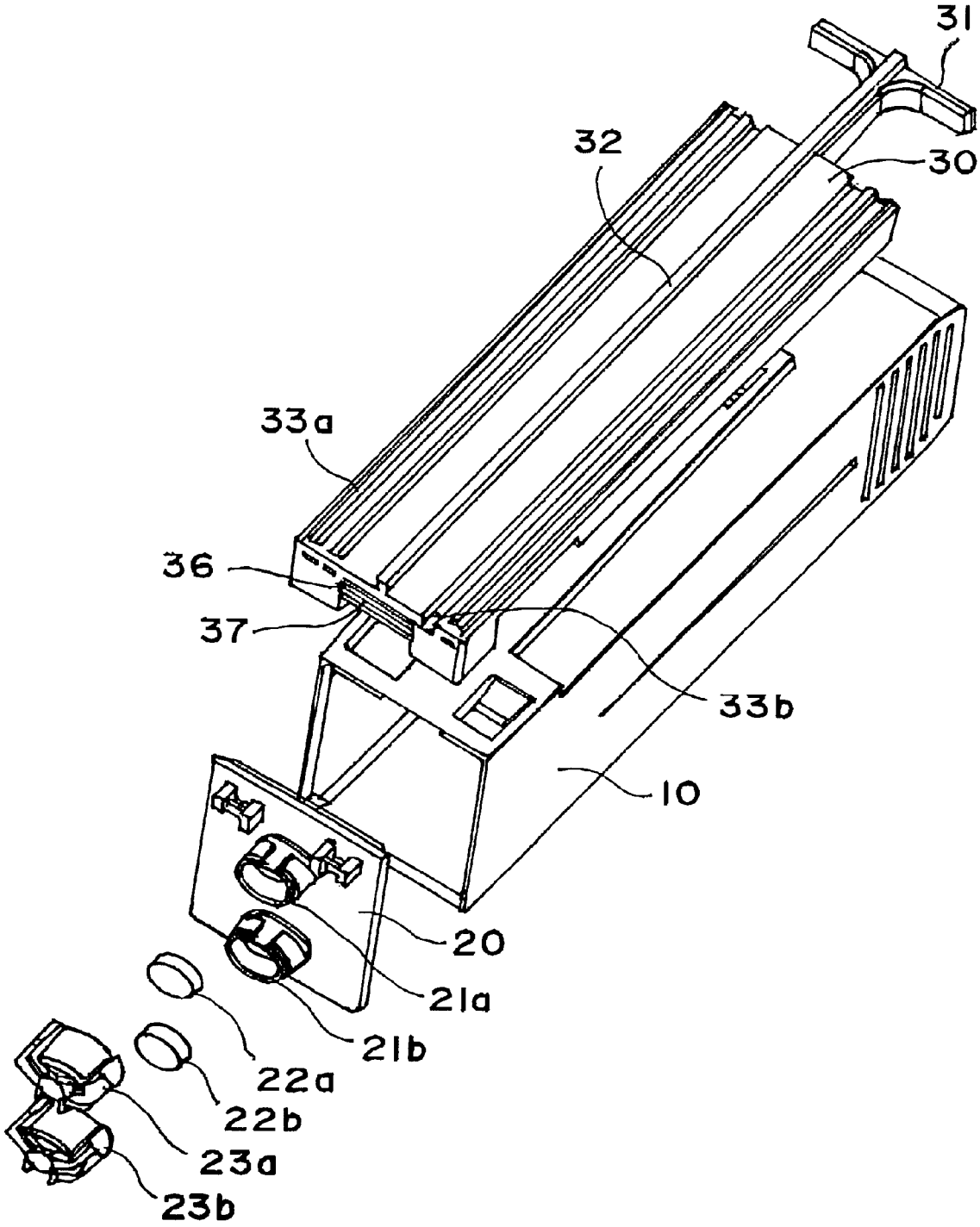
FIG. 1 is a drawing for describing one of the embodiments of a recording apparatus in accordance with the present invention.
Figure 2:
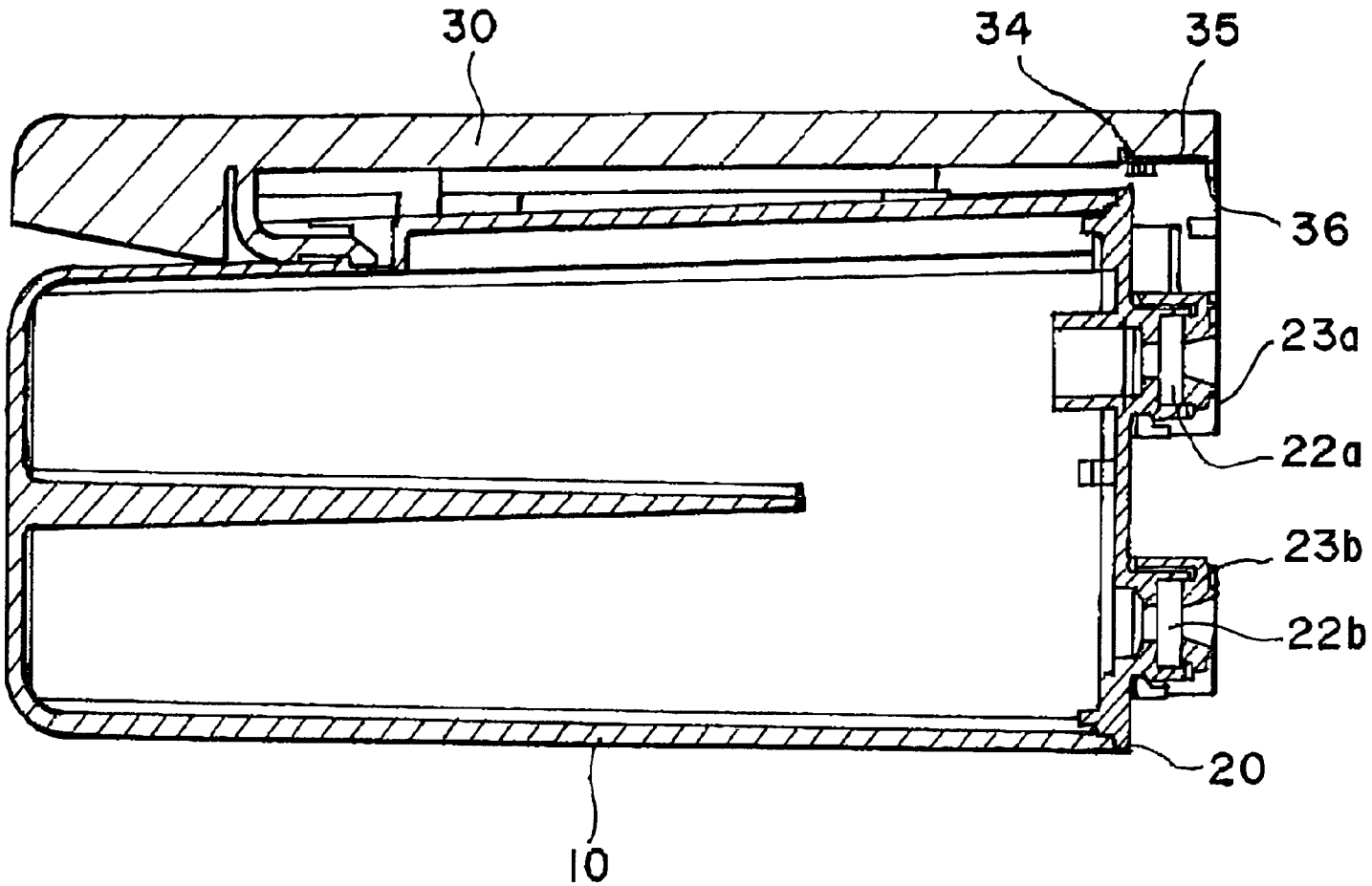
FIG. 2 is a sectional view of the ink cartridge shown in FIG. 1.

FIG. 1 is a drawing for describing an example of the recording apparatus in accordance with the present invention. More specifically, it is an exploded perspective view of an ink cartridge, that is, an example of the liquid container removably mountable in the main apparatus of an image forming apparatus. FIG. 2 is a sectional view of the ink cartridge shown in FIG. 1.

As shown in FIGS. 1 and 2, the ink container in this embodiment comprises: an ink container 10 for storing ink; and housings 21*a* and 21*b* which serve as the liquid path between the ink container and the recording apparatus main assembly; a lid 20 for sealing the ink container 10; dorm-shaped elastic members 22*a* and 22*b* which are mounted one for one in the housings 21*a* and 21*b* to establish a path, through which gas and liquid are exchanged between the ink cartridge and recording apparatus main assembly, as the ink cartridge is mounted in the recording apparatus main assembly; crowns 23*a* and 23*b* for retaining the elastic members 22*a* and 22*b*; a guide rib 32 which functions as a means for guiding the ink cartridge when the ink cartridge is mounted in the recording apparatus main assembly; grooves 33*a* and 33*b* which also function as means for guiding the ink cartridge when the ink cartridge is mounted in the recording apparatus main assembly; and a cover fitted over the ink container 10. The ink container 10 and lid 20 are joined with each other by ultrasonic welding. The cover 30 is provided with a handle 31, which is used when the ink cartridge is mounted into the recording apparatus main assembly. The cover 30 and an ink containing portion mainly comprising the ink container 10 constitutes an ink cartridge.

Further, the ink cartridge in this embodiment is provided with a storage element 34, which is located within the ink cartridge, and is usually an EEPROM, or the like. The storage element 34 stores supervisory data, control data, identification data. liquid amount data, maker data, and the like, regarding the recording apparatus main assembly and the ink cartridge. Thus, as the ink cartridge is mounted into the recording apparatus main assembly, the data within the storage element 34 are read by the recording apparatus main assembly, and the head and the like are controlled based on the read data.

Referring to FIG. 2, the storage element 34 is located in an electrode insertion slot 37, which is provided in the cover 30, and into which the electrode on the recording apparatus main assembly side is inserted. More specifically, it is placed on the inwardly facing surface of the cover 30, that is, the surface opposite to the surface where the guide ribs 30 are located. As the first electrode 35 connected to the storage element 34 comes into contact with the electrode on the recording apparatus main assembly side, the data stored in the storage element 34 are read by the recording apparatus main assembly.

At the entrance of the electrode insertion slot 35, the wall of the electrode insertion slot 37, on which the electrode 35 is located, is provided with a stepped portion 36 In other words, the electrode 35 is located on the recess created by the stepped portion 36, covering the inwardly facing surface of the cover, across the portion comparable to the bottom level of a step, without extending over the portion comparable to the upper level of the step.

Next, the relationship in which the housings 21*a* and 21*b*, elastic members 22*a* and 22*b*, and crowns 23*a* and 23*b* are put together will be described with reference to the relation in which the housing 21*a*, elastic member 22*a*, and crown 23*a* are put together.

Figure 3:
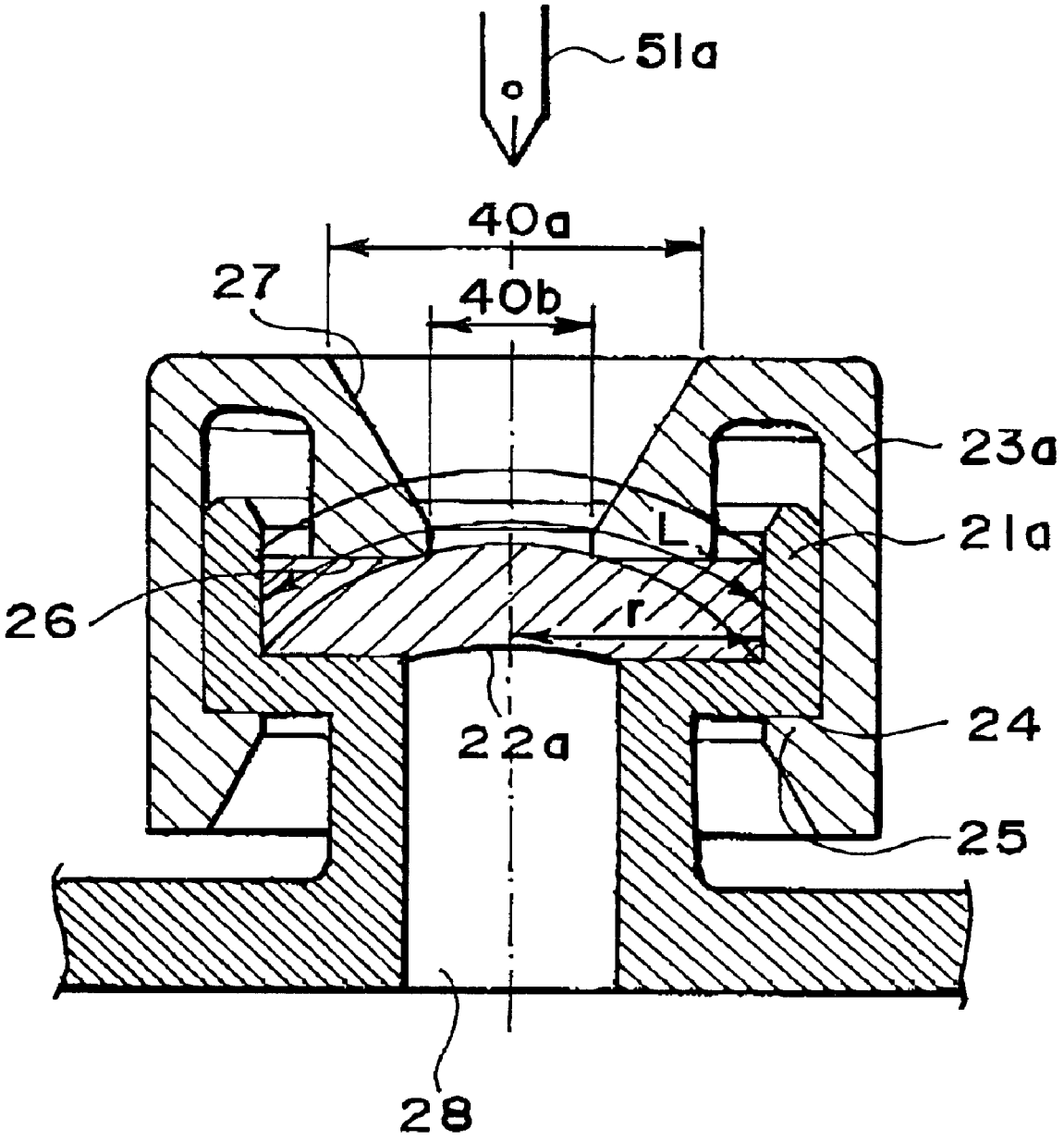
FIG. 3 is a drawing for describing how the housing and drown, shown in FIGS. 1 and 2, are connected to each other.

FIG. 3 is a sectional view of the housing 21*a*, elastic member 22*a*, and crown 23*a* shown in FIGS. 1 and 2, for describing the relationship in which they are put together.

Referring to FIG. 3, the crown 23*a* is provided with: claws 25 which engage with claw catching portions 24 of the housing 21*a*; pressing portions 26 for pressing the elastic member 22*a* in the direction approximately perpendicular to the diameter direction of the elastic member 22*a*; and an opening 27 for guiding the hollow needle 51*a* of the recording apparatus main assembly. The crown 23*a* is attached to the housing 21*a* in a manner to cap the housing 21*a*. The opening 27 is shaped so that its diameter 40*a* on the side by which the crown 23*a* engages with the recording apparatus main assembly is greater than its diameter 40*b* on the side by which the crown 23*a* engages with the housing 21*a*. Therefore, the positional deviation of the hollow needle 51*a* of the recording apparatus main assembly is prevented; it is assured that the hollow needle 51*a* will be positioned approximately in the center of the elastic member 22*a* even if the needle is initially misaligned with the elastic member 22*a* when it is moved into the opening 27. As the hollow needle 51*a* penetrates elastic member 22*a*, a passage is established between the interior of the ink container 10 and the recording apparatus main assembly, through the ink path 28 and hollow needle 51*a*.

Prior to the mounting of the crown 23*a*, the elastic member 22*a* is in the state outlined by a dotted line. However, when the crown 23*a* is mounted, the elastic member 22*a* is pressed by the pressing portions 26 of the crown 23*a* in the direction approximately perpendicular to the diameter direction of the elastic member 22*a*, being therefore deformed. Therefore, after the mounting of the crown 23*a*, the elastic member 22*a* fits in the housing 21*a* as outlined by the solid line in the drawing.

Before the elastic member 22*a* is placed in the housing 21*a*, its diameter L is greater than that of the internal diameter 2r of the housing 21*a*: L>2r. Therefore, after the elastic member 22*a* is pressed into the housing 21*a* by the crown 23*a*, the elastic member 22*a* tends to expand in the diameter direction of the housing 21*a*: such potential force that works in a manner to expand the elastic member 22*a* in the diameter direction of the housing 21*a* is present within the elastic member 22*a*. Since this force remains restrained by the crown 21*a*, the elastic member 22*a* remains compressed in the diameter direction by the housing 21*a* and crown 23*a*.

The hollow needle 51*a* is inserted into, or pulled out of, the ink container 10 through the elastic member 22*a* while the elastic member 22*a* remains in the above described compressed state. Thus, the hole made through the elastic member 22*a* by the penetration of the elastic member 22*a* by the hollow needle 51*a* is instantly closed as the hollow needle 51*a* is pulled out. In other words, as soon as the hollow needle 51*a* is pulled out of the elastic member 22*a*, the elastic member 22*a* is restored to virtually the same state as it was before the penetration of the elastic member 22*a* by the hollow needle 51*a*, preventing the ink, or the content of the ink container 10, from oozing out of the ink container 10.

Next, a container holder unit on the recording apparatus main assembly side, into which an ink cartridge such as the one described above is mounted, will be described.

Figure 4A:
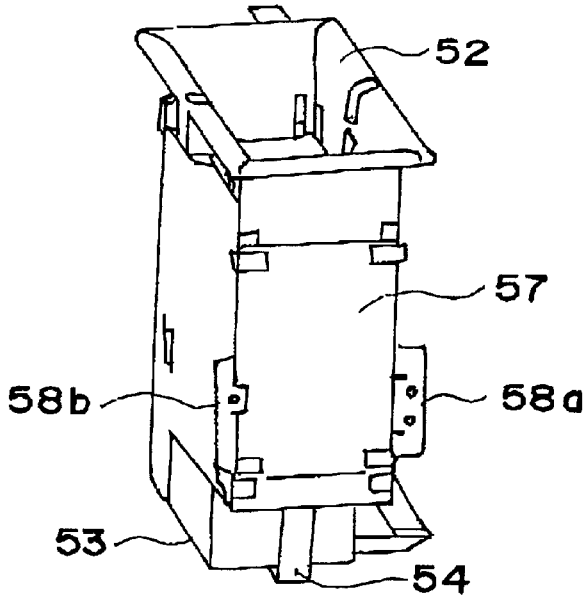
FIG. 4 is a perspective view of the container holder unit into which the ink cartridge shown in FIGS. 1 and 2 is mounted.
Figure 4B:
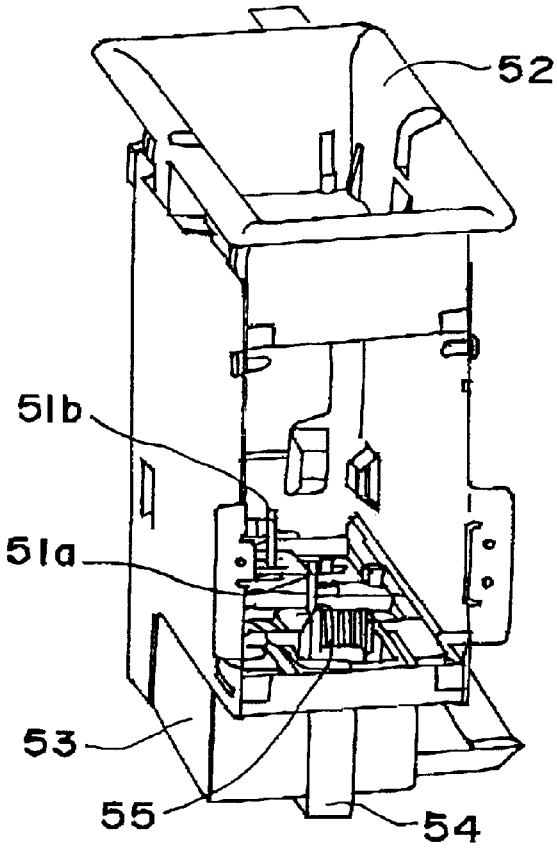

FIG. 4 is a perspective view of the ink container holder unit into which the ink cartridge shown in FIGS. 1 and 2 is inserted; FIG. 4(*a*) shows the unit, with a container rail 57 in place, and FIG. 4(*b*) shows the unit, with the container rail having been removed.

As shown in FIG. 4, the container holder unit in this embodiment has: a container slot 52, into which the ink cartridge is inserted; a container rail 57 provided with a guide rail (unshown) positioned to guide the ink cartridge to a proper position in the recording apparatus main assembly by engaging with the guide rib 32 of the ink cartridge; a buffer container 53 which serves as a member for stopping the inward movement of the ink cartridge when the ink cartridge is inserted into the container holder unit; a plurality of contacts 55; a second electrode 54 which causes the contacts 55 to contact electrodes 35 in the ink cartridge, by being assisted by its own resiliency, as the ink cartridge is inserted into the container holder unit; sharply pointed hollow needles 51*a* and 51*b*, which have an opening adjacent to the sharp point, and penetrate one for one through the elastic members 22*a* and 22*b* within the ink cartridge as the ink cartridge is inserted into the container holder unit; and screw holes 58*a* and 58*b* for attaching the container holder unit to the chassis of the recording apparatus main assembly. The electrode 54 is also a leaf spring, and is bent in such a manner that, when the ink cartridge is in its normal position within the container holder unit, the contacts 55 remain in contact with the electrode 35 on the ink cartridge side, without coming into contact with the upper level portion of the stepped portion 36.

Next, the operation for mounting the above described ink cartridge into the recording apparatus main assembly will be described.

Figure 5:
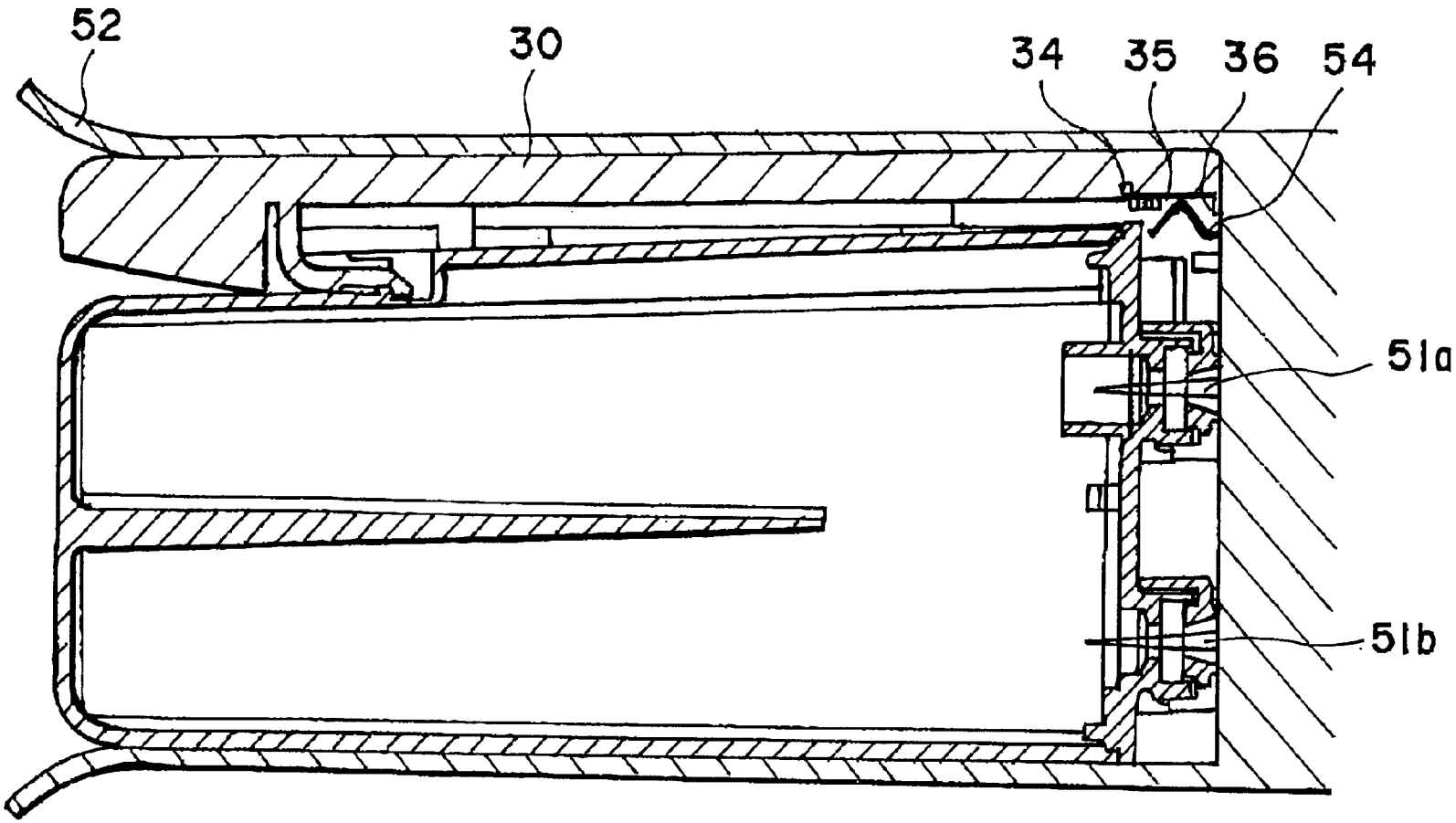
FIG. 5 is a sectional view of the container holder unit, shown in FIG. 4, in which the ink cartridge shown in FIGS. 1 and 2 has been mounted.

FIG. 5 is a sectional view of the ink cartridge shown in FIGS. 1 and 2, and the adjacencies thereof, after the ink cartridge has been completely inserted into the container holder unit shown in FIG. 4

When mounting the ink cartridge into the recording apparatus main assembly, first, ink cartridge is positioned against the container holder unit so that the guide rib 32 of the ink cartridge properly engages with the guide rail on the recording apparatus main assembly side, and then, the ink cartridge is inserted into the container holder unit.

As the ink cartridge is inserted into the container holder unit, the hollow needles 51*a* and 51*b* of the container holder unit penetrate all the way through the elastic members 22*a* and 22*b*. As a result, passage are established between the interior of the ink container 10 and the recording apparatus main assembly, allowing gas and liquid to be exchanged between the ink cartridge 10 and the recording apparatus main assembly.

The ink which has been stored in the ink container 10 is supplied to the recording apparatus main assembly through either the hollow needle 51*a* or 51*b* having penetrated the corresponding elastic members 22*a* and 22*b*, and the air is sent into the ink container 10 in return through the other hollow needle.

As the ink cartridge is further inserted into the container holder unit, the contacts 55 of the electrode 54 ride, being helped by the resiliency of the electrode 54 itself, over the upper level portion of the stepped portion 36. Then, as the ink cartridge is further inserted to its normal location in the container holder unit, the contacts 55 come into contact with the electrode 35 of the ink cartridge, establishing electrical connection between the ink cartridge and recording apparatus main assembly.

As a result, it becomes possible for the data stored in the storage element 34 to be read by the recording apparatus main assembly. Incidentally, the provision of the stepped portion 36 provides a user with a clocking sensation along with a clicking sound, assuring the user that the ink cartridge has been properly mounted in the recording apparatus main assembly, and that proper electrical connection has been established between the ink cartridge and recording apparatus main assembly.

As described above, the electrode 54 in this embodiment, which also is a leaf spring, is used not only as a latching means but also as a means for establishing electrical connection between the ink cartridge and recording apparatus main assembly.

Further, in this embodiment, the electrode 35 is disposed on the inwardly facing surface of the cover 30 in a manner to oppose the guide rib 32 through the cover 30, and therefore, the electrode 35 is easily and accurately positioned.

Figure 6:
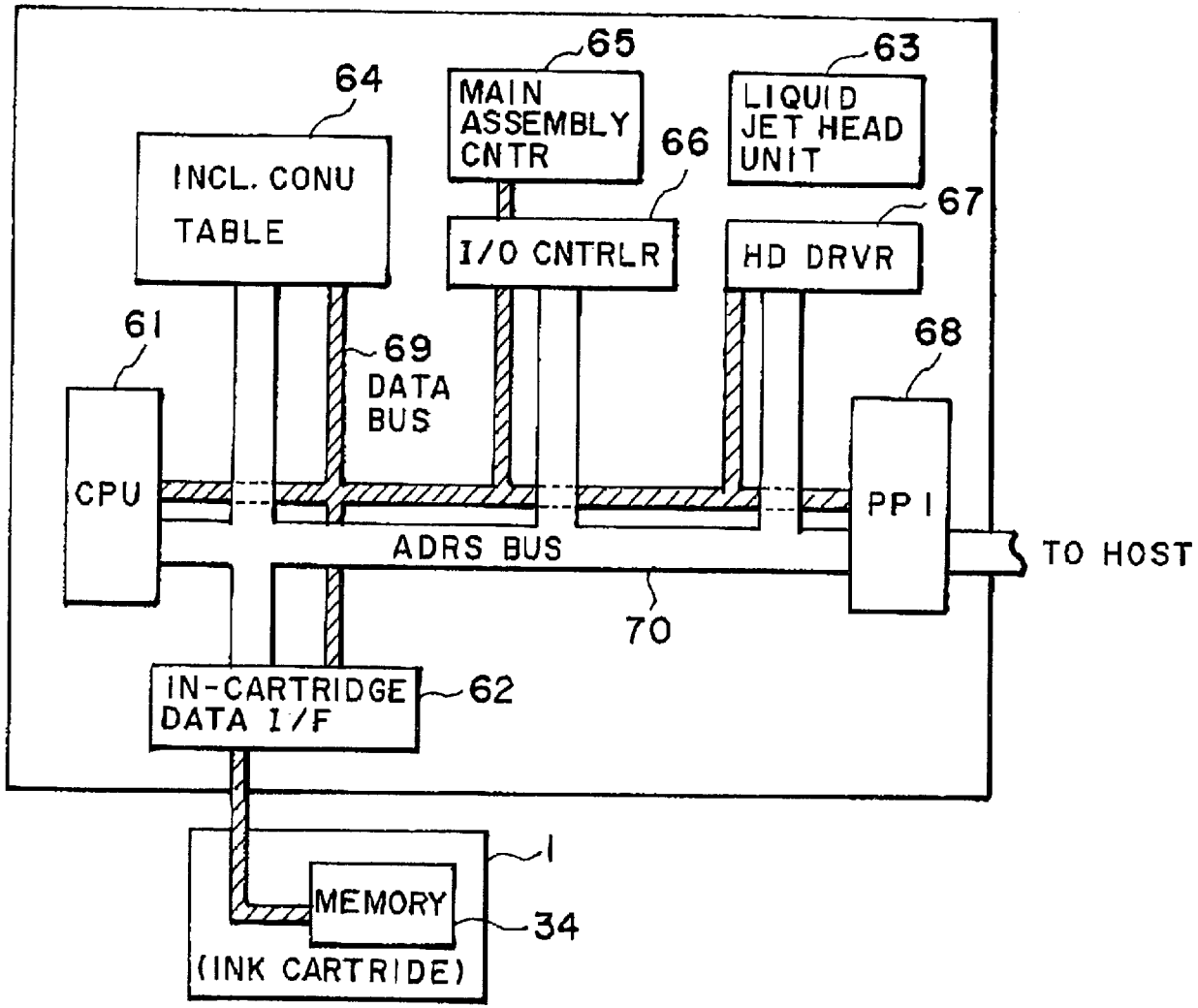
FIG. 6 is a block diagram for showing an example of the configuration for the recording apparatus 4 comprising the ink cartridge shown in FIGS. 1 and 2, and the container holder unit shown in FIG. 4

FIG. 6 is a block diagram for showing an example of electrical circuit in the recording apparatus main assembly which comprises the ink cartridge shown in FIGS. 1 and 2 and the container holder unit shown in FIG. 4.

As shown in FIG. 6, the electrical circuit in this embodiment comprises; a cartridge data I/F 62 as the interface for the data stored in the storage element 34 in the ink cartridge 1; a head 63 which carries out an actual printing operation; a head driver 67 which drives the head 63; a recording apparatus main assembly controller 65; an I/O controller 66; a ROM/RAM 64; a CPU 61, and a PPI 68. The cartridge data I/F 62, CPU 61, ROM/RAM 64, I/O controller 66, head driver 67, and PPI 68 are connected to each other through an address bus 70, and the storage element 34 in the ink cartridge 1, cartridge data I/F 62, I/O controller 66, recording apparatus main assembly controller 65, cartridge data I/F 62, CPU 61, ROM/RAM 64, I/O controller 66, head driver 67, and PPI 68 are connected to each other through a data bus 69.

As the ink cartridge 1 is inserted into the container holder unit of the recording apparatus main assembly structured as described above, the electrode 35 of the ink cartridge 1 comes into contact with the contacts 55 of the container holder unit. As a result, the data stored in the storage element 34 disposed within the ink cartridge 1 are transmitted to the recording apparatus main assembly through the I/O 62, and the head or the like are controlled based on the transmitted data.

[Embodiment 2]

Figure 7:
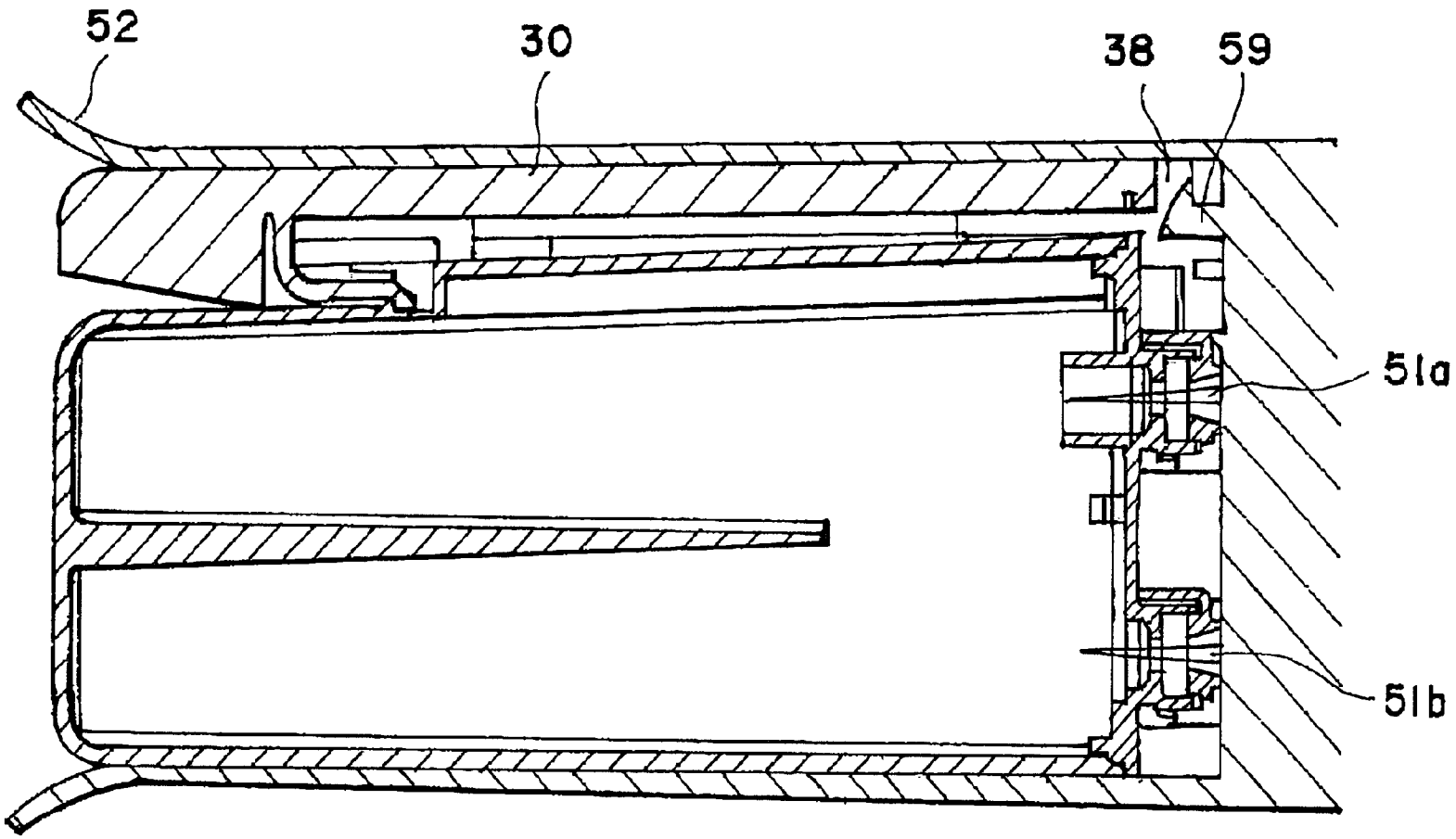
FIG. 7 is a drawing for showing another embodiment of the recording apparatus in accordance with the present invention.
Figure 8:
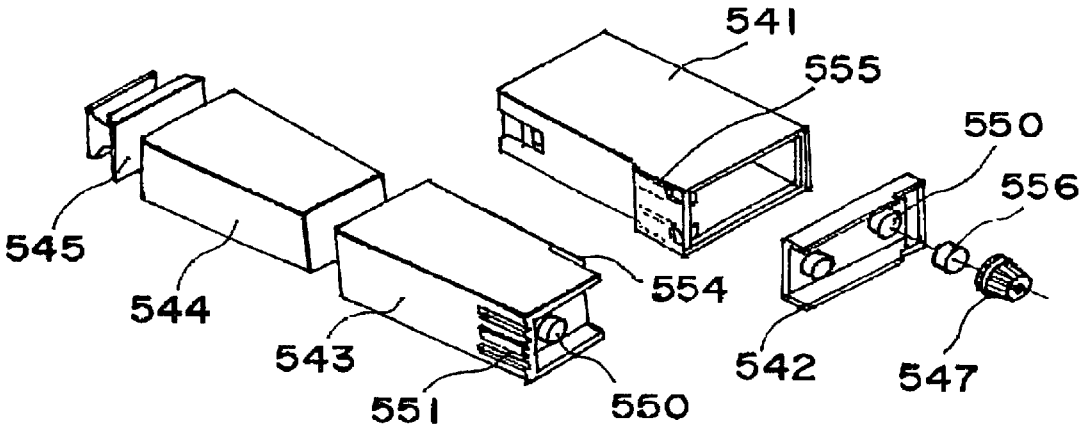
FIG. 8 is an exploded perspective view of an example of the ink cartridge mountable in a conventional recording apparatus, and shows the structure thereof.
Figure 9:
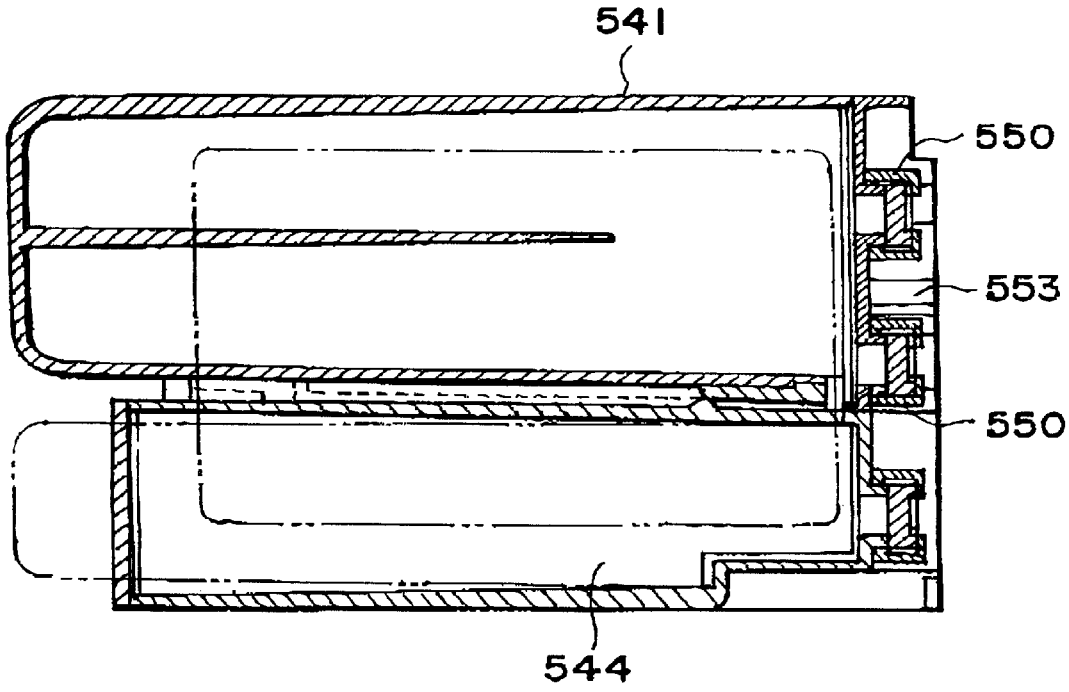
FIG. 9 is a sectional view of the ink cartridge shown in FIG. 8.

FIG. 7 is a drawing for showing the recording apparatus main assembly in the another embodiment of the present invention, more specifically, the state of the ink cartridge properly disposed within the container holder unit.

In this embodiment, the electrodes 35 and 54 shown in FIG. 5 are not provided. In other words, electrical contact is not established between the ink cartridge and recording apparatus main assembly. Instead, the cover 30 of the ink cartridge is provided with a hole 38 which serves as a latching means as the ink cartridge is inserted into the container holder unit, whereas the recording apparatus main assembly is provided with a lever 59 with a claw which snaps into the hole 38 as the ink cartridge is insert to its normal position in the recording apparatus main assembly.

As the ink cartridge is inserted to its normal position in the container holder unit of the recording apparatus main assembly structured as described above, the claw of the lever 59 of the container holder unit snaps into the hole 38 of the cover 30 of the ink cartridge, becoming hooked thereby. As he claw snaps into the hole 38, it makes a clicking sound along with a clicking sensation, which enables a user to recognize that the ink cartridge has been properly mounted in the recording apparatus main assembly.

The present invention, according to which an ink cartridge and the main assembly of a recording apparatus are structured as described above, brings forth such effects as will be described below.

A liquid container is provided with a stepped portion, creating a recess in which a first electrode connected to a storage element is placed. A second electrode which is placed in contact with the first electrode to allow the data stored in the storage element to be read by the main assembly of a recording apparatus is given such resiliency that causes the second electrode to restore its original shape after being pressed against the upper level of the stepped portion. Thus, as the liquid container is inserted into the recording apparatus main assembly, the second electrode, or the electrode on the recording apparatus main assembly side, is inserted, being pressed upon the upper level of the stepped portion, into the opening of the ink cartridge. As the second electrode rides over the upper level portion of the stepped portion, or the upper level of the stepped portion, the second electrode instantly snaps back into its original shape, coming into contact with the first electrode placed in the recess created by the provision of the stepped portion, while providing a user with a clicking sensation and generating a clicking sound. The clicking sensation and sound enable the user to recognize that the liquid container has been properly mounted in the recording apparatus main assembly, and that proper electrical connection has been established between the ink cartridge and recording apparatus main assembly. Thus, according to the present invention, it is possible to substantially reduce the possibility that the liquid container and/or recording apparatus main assembly will be damaged.

Further, the liquid container is provided with a guiding means for guiding the ink cartridge when the ink cartridge is mounted into the recording apparatus main assembly, and the first electrode is disposed on the inwardly facing surface of the wall provided with the guiding means, in such a manner that the first electrode opposes the guiding means through the wall. Therefore, the first electrode is easily and accurately positioned.

Further, the liquid container is provided with a slot, in which the first electrode and storage element are placed, and the outward end of the wall of the slot is provided with a stepped portion, preventing the first electrode and storage element from being covered with the liquid.

Further, the second electrode is bent so that it will remain out of contact with the upper level portion of the stepped portion located at the outward end of the space, when the second electrode is in contact with the first electrode. Therefore, when the second electrode is in contact with the first electrode, the second electrode does not make contact with the upper level portion of the stepped portion, being prevented from being damaged.

Further, according to another aspect of the present invention, the liquid container is provided with a hole which has no relation to the supplying of liquid to the recording apparatus main assembly, and into which a lever provided on the recording apparatus main assembly side engages as the liquid container is inserted to its normal position in the recording apparatus main assembly. Thus, as the liquid container is inserted to its normal position in the recording apparatus main assembly, the lever snaps into this hole, giving a user a clicking sensation and generating a clicking sound at the same time. The clicking sensation and sound enable a user to recognize that the liquid container has been properly mounted in the recording apparatus main assembly. As a result, the possibility that the liquid container and/or recording apparatus main assembly will be damaged when the former is mounted into the latter is reduced.

In addition, the liquid container is provided with a slot into which the second electrode is inserted, and the aforementioned hole is placed within the slot for the second electrode. Therefore, the hole is not soiled by the splashed liquid.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for containing liquid to be used for recording, said liquid container being detachably mountable to a recording device, said liquid container comprising:

a casing having a liquid containing portion for containing the liquid;

a supply portion for delivering the liquid;

an air introducing portion for introducing air in accordance with delivery of the liquid;

a storing element storing information and having a first electrical contact for receiving information from outside said liquid container and supplying information to outside, wherein said storing element is disposed on a side extending substantially in a direction of mounting of said liquid container to said recording device, and adjacent a front end of said liquid container; and a stepped portion projected inwardly of said liquid container and extended in a direction crossing with the mounting direction, at the front end of said liquid container, wherein an inward end of said stepped portion is more inside of said liquid container than a surface of said first electrode of said storing element.

2. An apparatus according to claim 1, wherein said stepped portion is provided by forming a recessed portion for supporting said storing element.

3. An apparatus according to claim 1, wherein said stepped portion is provided by a projected strip.

4. An apparatus according to claim 2, wherein said storing element is provided on an inside surface of said casing.

5. An apparatus according to claim 3, further comprising a guide for guiding said liquid container into said recording device, said guide is provided on an outside of said casing at a position corresponding to said storing element.

6. An apparatus according to claim 5, wherein said storing element is provided on an inside surface of said casing.

7. An apparatus according to claim 6, further comprising a guide for guiding said liquid container into said recording device, said guide is provided on an outside of said casing at a position corresponding to said storing element.

8. A recording device to which said liquid container as defined in claim 1 is mountable, said recording device comprising:

a mounting portion for detachably mounting said liquid container;

an ink receiving member contactable with said ink delivery portion of said liquid container;

an air introducing member contactable with said air introducing portion of said liquid container; and a second electrical contact electrically connectable with said first electrical contact of said storing element;

wherein said second electrical contact is resilient such that it rides over said stepped portion to resiliently and electrically contact said first electrical contact in a clicking fashion, and said second electrical contact is disposed in said mounting portion with a space for allowing deformation thereof to ride over said stepped portion.

9. A recording device according to claim 8, wherein said second electrical contact has a curved portion to avoid contact with said stepped portion when said second electrical contact is contacted to said first electrical contact.

* * * * *

UNITED STATES PATENT AND TRADEMARK OFFICE

CERTIFICATE OF CORRECTION

PATENT NO. : 6,431,681 B2
DATED : August 13, 2002
INVENTOR(S) : Nobuyuki Hatasa et al.

It is certified that error appears in the above-identified patent and that said Letters Patent is hereby corrected as shown below:

Title page,
Item [57], ABSTRACT,
Line 10, “such a stepped portion that” should read -- a stepped portion such that the --.

Drawings,
Sheet 6, FIG. 6, “CARTRIDE)” should read -- CARTRIDGE) --.

Column 3,
Line 8, “means” should read -- makes --; and
Line 10, “completes” should read -- compels --.

Column 4,
Line 48, “enables” should read -- enable --.

Column 5,
Line 8, “drown,” should read -- crown, --; and

Column 6,
Line 25, “36” should read -- 36. --.

Column 8,
Line 8, “passage” should read -- passages --; and
Line 31, “clocking” should read -- clicking --.

Column 9,
Line 6, “are” should read -- is --;
Line 10, “in the” should read -- in --;
Line 21, “insert to” should read -- inserted into --; and
Line 28, “he” should read -- the --.

UNITED STATES PATENT AND TRADEMARK OFFICE

CERTIFICATE OF CORRECTION

PATENT NO. : 6,431,681 B2
DATED : August 13, 2002
INVENTOR(S) : Nobuyuki Hatasa et al.

It is certified that error appears in the above-identified patent and that said Letters Patent is hereby corrected as shown below:

Column 11,
Line 5, “claim 3,” should read -- claim 4, --;
Line 7, “is” should read -- being --;
Line 9, “claim 5,” should read -- claim 3, --; and
Line 13, “is” should read -- being --.

Signed and Sealed this

Seventh Day of January, 2003

JAMES E. ROGAN
*Director of the United States Patent and Trademark Office*